US012655531B2

(12) United States Patent
Fujita et al.

(10) Patent No.: US 12,655,531 B2
(45) Date of Patent: Jun. 16, 2026

(54) ELECTROLYSIS SYSTEM AND METHOD OF USE THEREOF

(71) Applicant: ASAHI KASEI KABUSHIKI KAISHA, Tokyo (JP)

(72) Inventors: Yasuhiro Fujita, Tokyo (JP); Hiroyuki Togo, Tokyo (JP); Hirokazu Nagate, Tokyo (JP); Yousuke Uchino, Tokyo (JP); Keisuke Nakashima, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 620 days.

(21) Appl. No.: 17/996,221

(22) PCT Filed: Apr. 14, 2021

(86) PCT No.: PCT/JP2021/015459
§ 371 (c)(1),
(2) Date: Oct. 14, 2022

(87) PCT Pub. No.: WO2021/210611
PCT Pub. Date: Oct. 21, 2021

(65) Prior Publication Data

US 2023/0220575 A1 Jul. 13, 2023

(30) Foreign Application Priority Data

Apr. 16, 2020 (JP) ..... 2020-073416

(51) Int. Cl.
*C25B 15/025* (2021.01)
*C25B 1/04* (2021.01)
*C25B 9/77* (2021.01)

(52) U.S. Cl.
CPC ..... *C25B 15/025* (2021.01); *C25B 1/04* (2013.01); *C25B 9/77* (2021.01)

(58) Field of Classification Search
CPC ..... C25B 1/04; C25B 15/02; C25B 15/023–15/025
See application file for complete search history.

(56) References Cited

U.S. PATENT DOCUMENTS 4,430,179 A 2/1984 Ford et al.
4,846,951 A * 7/1989 Gardner, Sr. ..... C25B 15/00 204/266

(Continued)

FOREIGN PATENT DOCUMENTS

CA 3120274 A1 5/2020
FR 2394620 A1 1/1979

(Continued)

OTHER PUBLICATIONS

Dec. 18, 2024, the Supplementary European Search Report issued by the European Patent Office in the corresponding European Patent Application No. 21788112.7.

(Continued)

*Primary Examiner* — Alexander W Keeling
(74) *Attorney, Agent, or Firm* — KENJA IP LAW PC

(57) ABSTRACT

An electrolysis system of the present disclosure includes an electrolyzer which includes an electrode to generate a gas from the electrode, and a tightening device which controls a tightening load on the electrolyzer in accordance with a pressure of the gas.

9 Claims, 12 Drawing Sheets

(56) References Cited

U.S. PATENT DOCUMENTS

| | | | | |
|---|---|---|---|---|
| 2002/0100681 | A1 | 8/2002 | Kirk et al. | |
| 2004/0072040 | A1* | 4/2004 | Duffy | C25B 1/04 204/278 |
| 2011/0024303 | A1* | 2/2011 | Cerny | C25B 1/04 204/278.5 |
| 2015/0001067 | A1 | 1/2015 | Mantai et al. | |
| 2017/0247800 | A1* | 8/2017 | Lacroix | C25B 9/00 |
| 2021/0040631 | A1 | 2/2021 | Tanaka et al. | |
| 2021/0115573 | A1 | 4/2021 | Tanaka et al. | |
| 2022/0195613 | A1 | 6/2022 | Suzuki et al. | |

FOREIGN PATENT DOCUMENTS

| | | | |
|---|---|---|---|
| JP | S5388667 | A | 8/1978 |
| JP | H07126883 | A | 5/1995 |
| JP | H09176883 | A | 7/1997 |
| JP | 2001131787 | A | 5/2001 |
| JP | 2003160891 | A | 6/2003 |
| JP | 2003342769 | A | 12/2003 |
| JP | 2005097644 | A | 4/2005 |
| JP | 2011046979 | A | 3/2011 |
| JP | 2019163524 | A | 9/2019 |
| JP | 6594601 | B1 | 10/2019 |
| WO | 2017191353 | A1 | 11/2017 |
| WO | 2019188260 | A1 | 10/2019 |
| WO | 2020203319 | A1 | 10/2020 |

OTHER PUBLICATIONS

Oct. 13, 2022, International Preliminary Report on Patentability issued in the International Patent Application No. PCT/JP2021/015459.

Jun. 29, 2021, International Search Report issued in the International Patent Application No. PCT/JP2021/015459.

* cited by examiner

ELECTROLYSIS SYSTEM AND METHOD OF USE THEREOF

TECHNICAL FIELD

The present disclosure relates to an electrolysis system and a method of use thereof.

BACKGROUND

Alkaline water electrolysis in which hydrogen gas is generated from a cathode and oxygen gas is generated from an anode has been conventionally known as one example of electrolysis. An improvement has been made on alkaline water electrolysis for producing a gas having a high purity while controlling the composition of the gas generated in continuous operation, for example (PTL 1).

CITATION LIST

Patent Literature

PTL 1: JP 6594601 B

SUMMARY

Technical Problem

In recent years, techniques utilizing renewable energy, such as wind power generation and solar power generation, have attracted attention in order to address the issues including global warming due to greenhouse gases such as carbon dioxide, decrease of fossil fuel reserves, and so on.

Studies have been also made on electrolysis apparatuses utilizing electric power generated from renewable energy as a power supply source. The output of renewable energy, however, depends on climate conditions and significantly fluctuate, and thus electrolysis apparatuses need to operate stably even if the supply of electric power significant fluctuates and start and stop operations are repeated quite frequently.

In particular, when supply of electric power fluctuates, the amounts of gases generated from electrodes in an electrolyzer fluctuate, and the gas pressures in the electrolyzer tend to be changed. Changes in the internal gas pressure inside the electrolyzer lead to changes in the tightening surface pressure, which is defined as the difference from the tightening load on the electrolyzer. As a consequence, the sealing structure and the internal structure may be damaged due to the excessive tightening surface pressure, or leaks may occur due to the loosening of the tightening surface pressure.

In addition, even under continuous operation conditions, unexpected changes in the surface pressure may occur due to power failure, failure of the apparatus, or the like, which may lead to similar problems.

Therefore, an object of the present disclosure is to provide an electrolysis system in which the tightening surface pressure is maintained within a certain range in an electrolyzer, whereby highly reliable operations are achieved.

Solution to Problem

The present disclosure thus provides the following.

(1)

An electrolysis system comprising:

an electrolyzer which comprises an electrode to generate a gas from the electrode, and a tightening device which controls a tightening load on the electrolyzer in accordance with a pressure of the gas.

(2)

The electrolysis system according to (1), wherein the tightening load changes in proportion to the pressure of the gas.

(3)

The electrolysis system according to (1) or (2), wherein the tightening load is maintained to a constant value when the pressure of the gas is within a certain range.

(4)

The electrolysis system according to any one of (1) to (3), wherein the tightening load is controlled with reference to an electrolysis current value.

(5)

The electrolysis system according to any one of (1) to (4), wherein the tightening device comprises an accumulator.

(6)

The electrolysis system according to (5), wherein a capacity of the accumulator is 0.1 L or more and 100 L or less.

(7)

The electrolysis system according to any one of (1) to (6), wherein the tightening device is an oil pressure tightening device.

(8)

The electrolysis system according to (7), wherein the electrolyzer comprises at least one electrolytic cell, and two press plates disposed at both ends of the electrolyzer so as to sandwich the at least one electrolytic cell, one of the two press plates and the oil pressure tightening device are connected to each other, the electrolysis system further comprises a heat insulating member between at least the press plate connected to the oil pressure tightening device and the at least one electrolytic cell, among the at least one electrolytic cell and the two press plates.

(9)

The electrolysis system according to any one of (1) to (8), wherein the electrolysis system is for alkaline water electrolysis.

(10)

A method of use of the electrolysis system according to any one of (1) to (9).

Advantageous Effect

Because the electrolysis system of the present disclosure has the above configurations, the tightening surface pressure on the electrolyzer is maintained to a substantially constant value, whereby highly reliable operations are achieved.

DETAILED DESCRIPTION

The following provides a detailed description of an embodiment of this disclosure (hereinafter, referred to as the "present embodiment"). The present disclosure is, however, not limited to the embodiments disclosed herein, and various modifications can be made within the spirit and scope of the disclosure.

[Electrolysis System]

An electrolysis system of a present embodiment includes an electrolyzer which includes an electrode to generate a gas from the electrode, and a tightening device which controls a tightening load on the electrolyzer in accordance with a pressure of the gas. The electrolysis system includes the electrolyzer and the tightening device, and may further include a power source, a rectifier, a detector, an accumulator, an auxiliary power source controller, an electrolytic solution circulating pump, gas-liquid separation tanks, an electric current meter, an electrolyte solution controller, a gas purifier, and the like.

Figure 1:
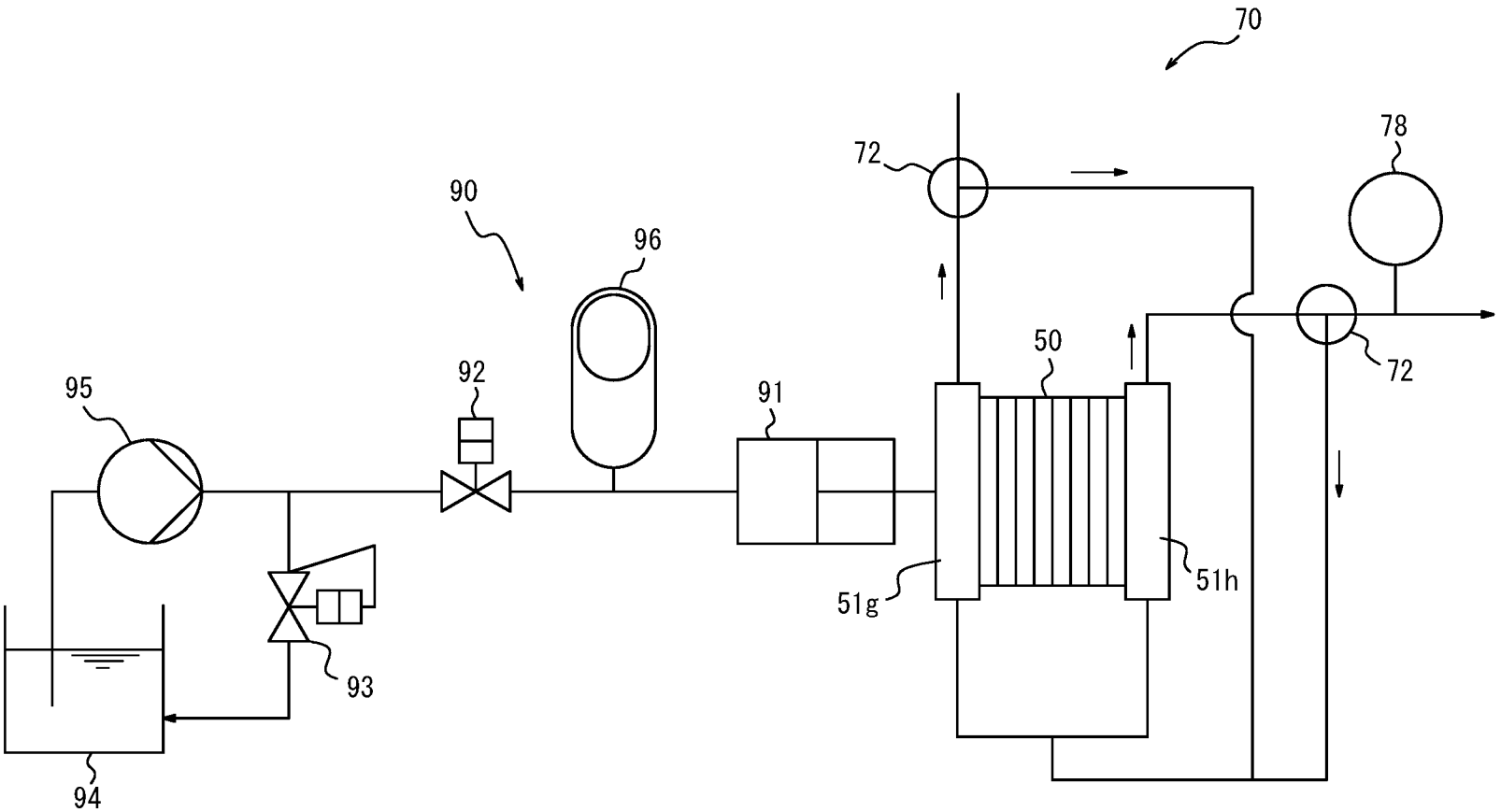
FIG. 1 is a schematic diagram illustrating one example of an electrolysis system of a present embodiment.

FIG. 1 illustrates one example of an electrolysis system. FIG. 1 is a diagram for illustrating a tightening device which controls a tightening load on an electrolyzer.

An electrolysis system 70 includes an electrolyzer 50 and a tightening device 90 for controlling a tightening load on the electrolyzer 50. The electrolysis system 70 may further include gas-liquid separation tanks 72 that separate the electrolytic solution and gases from the mixture of the electrolytic solution and the gases discharged from the electrolyzer, and pressure gauges 78 that measure the pressures of the gases generated from the electrodes in the electrolyzer.

Here, the load and the pressure acting on the electrolyzer will be described with reference to FIG. 5 using an alkaline electrolyzer 50 as an example.

The electrolyzer 50 is tightened with a tightening load $F_c$ during an electrolysis operation. A gasket 7 provided around the outer frame of the electrolyzer is tightened with the tightening surface pressure $P_g$. The average liquid head pressure $P_l$ caused by the electrolyte solution and the internal gas pressure $P_o$ caused by the gases generated from the electrodes act in the electrolyzer. $F_c$, $P_g$, $P_l$, and $P_o$ have the following relationship.

$$F_c=P_g\times S_g-(P_o+P_l)\times S_o$$

(where $S_g$ represents the sealing area of the gasket, and $S_o$ represents the pressure receiving area of the gases. These areas can be regarded as constants regardless of whether the electrolyzer is operated or stopped.)

Further, the electrolytic solution is usually controlled to be maintained to a constant level in order to reduce the electric resistance for increasing the efficiency of electrolysis as well as eliminating excess heat. Thus, the average head pressure $P_l$, which is directly proportional to the level of the electrolytic solution, can be considered constant. When the internal gas pressure $P_o$ changes, if the tightening load $F_c$ remains constant, the tightening surface pressure $P_g$ on the gasket would change, which might lead to insufficient tightening or excessive tightening of the electrolyzer.

To address this issue, according to the electrolysis system of the present embodiment, the internal gas pressure $P_o$ is measured in real time, and the tightening load $F_c$ on the electrolyzer is controlled in accordance with the measured gas pressure $P_o$. As a consequence, the tightening surface pressure $P_g$ on the gasket can be maintained substantially constant, whereby the reliability of electrolysis operations can be improved.

Although an alkaline electrolyzer has been described as an example in the above description, the electrolyzer to which the present disclosure is applied is not limited this electrolyzer, and may be applied to any electrolyzers, such as a solid polymer type electrolyzer and a solid oxide type electrolyzer, as long as the electrolyzer has a seal structure and has changes in the internal pressure.

(Tightening Device)

Examples of the tightening device 90 include tightening devices in an oil pressure type (FIG. 1), a pneumatic type, and a water hydraulic type. Among these, an oil pressure tightening device which has a fast response and is less affected by changes in the temperature is preferred.

The tightening device 90 may be composed of a cylinder 91 (for example, an oil pressure cylinder), a shut-off valve 92, a relief valve 93 (for example, an oil pressure relief valve), a tank 94 (for example, an oil tank), a pump 95 (for example, an oil pressure pump), or the like. For example, the relief valve 93 may be controlled in accordance with the pressure value indicated by a pressure gauge 78, so that the force to be applied to the cylinder 91 is controlled.

The tightening device 90 may include an accumulator (pressure accumulator) 96 in case of inability to maintain the pressure due to a power failure or the like.

The accumulator 96 is not particularly limited, and a conventionally known accumulator can be used.

The accumulator is generally composed of a container made of steel and a bladder (diaphragm made of a rubber) housed in the container. The container is provided with a connection port for an operating fluid and an gas introduction port for a gas, and has a structure where the operating fluid and the gas are separated from each other via the bladder. The operating fluid is selected from an oil, water, and the like, as described above, and the gas is generally selected from inert gases such as nitrogen gas.

The compressibility (the rate of volume change under uniform pressure) of the gas is much greater than that of water, an oil, and the like. Accordingly, the volume of the bladder flexibly changes in accordance with the change in the pressure of the operating fluid, so that changes of the pressure are mitigated.

For example, the pump 95 is stopped in case of a power failure, and even if the shut-off valve 92 is closed, the cylinder 91 would gradually extend due to a decrease in the temperature of the electrolyzer 50. As a result, there would be a possibility that the tightening pressure cannot be maintained, and eventually a liquid or gas leaks from the electrolyzer 50.

In contrast, in cases where the accumulator 96 is provided, the bladder filled with the gas expands due to the extension of the cylinder 91, and the tightening pressure can be maintained for a long time.

The capacity of the accumulator 96 is determined depending on the designs of the electrolyzer 50 and the tightening device 90, but is preferably 0.1 L or more and 100 L or less, more preferably 1 L or more and 50 L or less, and even more preferably 2 L or more and 20 L or less.

The tightening load preferably changes in proportion to the pressure of a gas generated at an electrode (e.g., the internal gas pressure).

The internal gas pressure of the electrolyzer 50 can be regarded to be the same as the pressure indicated by a pressure gauge 78. In other words, when an increase in the measurement value by the pressure gauge 78 is detected, the tightening device 90 controls the opening degree of the relief valve 93 to thereby increase the oil pressure acting on the cylinder 91, so that the tightening surface pressure on the electrolyzer 50 is maintained constant.

The proportion to increase the oil pressure in accordance with an increase in the internal gas pressure may be such that the tightening load may be linearly increased (the oil pressure control 1 in FIG. 6) or may be increased in a manner to draw a curve, in accordance with an increase in the internal gas pressure, for example.

On the contrary, when the internal gas pressure decreases, the oil pressure of the cylinder 91 is reduced, so that the tightening surface pressure on the electrolyzer 50 is maintained constant.

The tightening surface pressure is controlled so as to fall within a range of preferably 0.5 MPa to 4.0 MPa, more preferably 1.0 MPa to 3.0 MPa, and even more preferably 1.5 MPa to 2.5 MPa. If the surface pressure is lower than the above ranges, a gas or the electrolytic solution is likely to leak, or if the surface pressure is higher than the above ranges, creep of the gasket progresses and the gasket per se and the internal structure of the electrolyzer tend to be damaged.

The control on the tightening load on the electrolyzer in accordance with the gas pressure may be a feedback control in which a gas pressure-oil pressure conversion table has been entered into a control computer, and the opening degree of the relief valve is precisely controlled in real time in accordance with a change in the gas pressure so that the oil pressure approaches to a conversion value on the basis of the conversion table, for example.

The tightening device can correct and control the tightening load with reference to the electrolytic current value. As a more sophisticated control, an feed-forward control on the basis of the electrolytic current value can also be employed. More specifically, a feed-forward control is a read-ahead control relying on the fact that the electrolytic current value and the amount of generated gas have a proportional relation ship. A feed-forward control is preferred for electrolysis systems where the rate of change in the output is very high and thus a delay may occur in a feed-forward control relying on the gas pressure.

Figure 6:
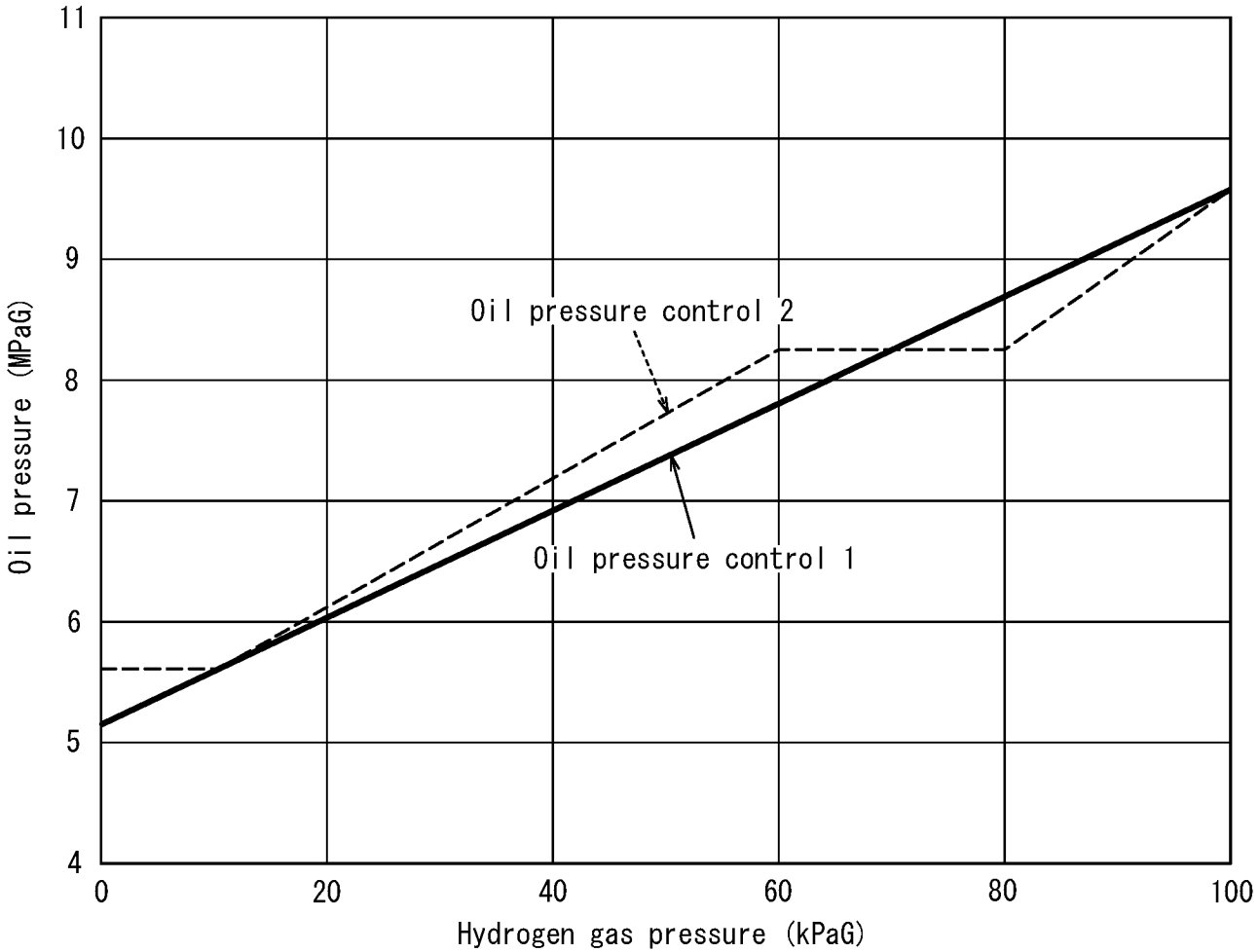
FIG. 6 is a schematic diagram illustrating two examples of control on the oil tightening pressure on an electrolyzer according to the internal gas pressure (the pressure of hydrogen gas) in the tightening device.

When an electrolyzer is connected to a power source of which fluctuation in the output are difficult to be predicted, such as renewable energy, if the tightening load on the electrolyzer is attempted to be controlled in accordance with the changes in the gas pressure, overshoot or undershoot may occur due to a delay of control, and tightening may become inappropriate. To address this issue, an effective control (oil pressure control 2 in FIG. 6) is such that the tightening load is maintained constant (a dead zones is provided) for changes in the gas pressure within a certain range, so that some changes in the tightening surface pressure are allowed. In other words, it is preferable that the tightening device maintains the tightening load to a constant value when the pressure of the gas is within the certain range. In FIG. 6, a dead zone is provided in order to maintain a constant oil pressure of 8.3 MPaG for the internal gas pressure ranging from 60 to 80 kPaG.

Furthermore, a method can also be used in which a dead zone is provided on the low-pressure side in order to maintain a minimum surface pressure for preventing leakage of the liquid or the like when the pressure of gas is equalized to the atmospheric pressure. In the embodiment of FIG. 6, a dead zone is provided in order to maintain the oil pressure to a constant value of 5.6 MPaG for lower gas pressures.

The range of the internal gas pressure in the dead zone may be determined according to the structure of the electrolyzer, the type and size of the power source, the type of a gas to be generated, and the like.

The setting width of the dead zone is preferably about ±20% of the designed surface pressure, and more preferably ±10% of the designed surface pressure.

The amount of the tightening load applied in the dead zone is not particularly limited, and a load may be applied in a range in which leakage of the electrolytic solution or the gas and excessive tightening of the electrolyzer do not occur, within a gas pressure range where the dead zone is provided, for example. The amount of the tightening load applied in the dead zone may be determined by determining the relationship between $F_c$, $P_g$, $P_l$, and $P_o$ described above using the same electrolyzer, for example.

Although the tightening load is changed in accordance with an increase or decrease in the gas pressure, the tightening load taking the liquid head pressure into consideration must be applied at minimum even when the pressure of the gas is below atmospheric pressure. For example, when the pressure of the gas is near atmospheric pressure, the tightening load may be set to a constant value so that the tightening load taking the liquid head pressure into consideration is 0.5 to 3 MPa.

The tightening device 90 preferably tightens so that a uniform force is applied to the gasket around the electrode.

The tightening device 90 may apply a tightening load from one end of the electrolyzer (e.g., the end on the loose head side) (FIGS. 1, 2, and 5), or from both ends of the electrolyzer. When gases are generated simultaneously from the anode and the cathode of the electrolyzer, the tightening load is preferably controlled in accordance with the higher one of the gas pressures. Nevertheless, unless the differential pressure between the anode and the cathode is extremely large, the tightening load may be controlled in accordance with one of the gas pressures as a representative value.

(Electrolyzer)

Figure 2:
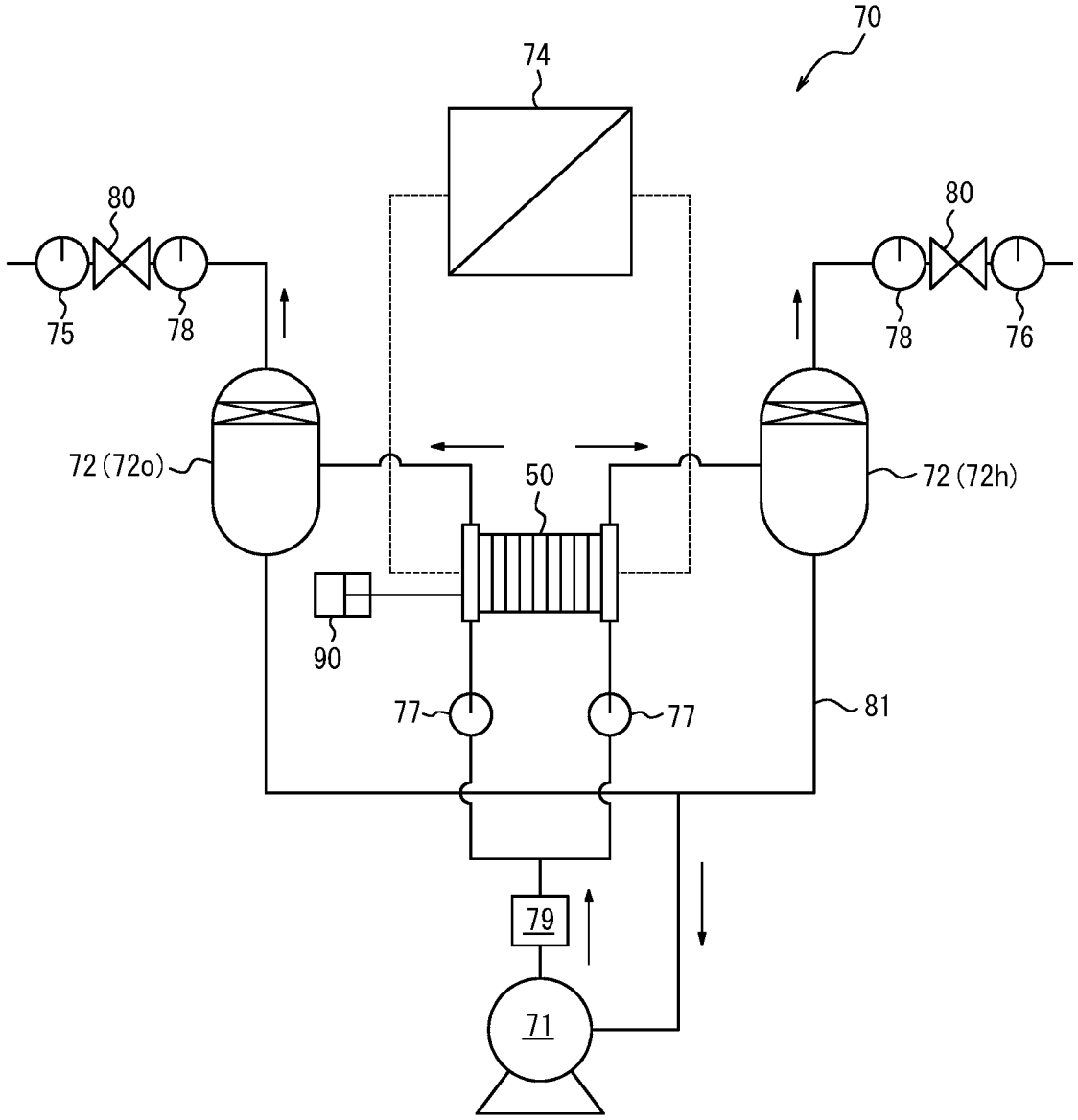
FIG. 2 is a schematic diagram illustrating one example of an electrolysis system of a present embodiment.

One example of the electrolysis system is illustrated in FIG. 2.

The electrolysis system 70 includes an electrolyzer 50 and a tightening device 90 which controls a tightening load on the electrolyzer 50, and may further include a feed power supply 74, an electrolytic solution circulating pump 71, gas-liquid separation tanks 72 (72*h*, 72*o*), concentration meters 75 and 76, flow meters 77, pressure gauges 78, a heat exchanger 79, piping 81, pressure control valves 80, and the like.

Note that the arrows in FIG. 1 indicate the directions along which the electrolytic solution or gases flows.

Hereinafter, components of the electrolysis system will be described in detail below.

The electrolyzer may be a unipolar type electrolyzer in which at least one electrode element is connected in parallel, or may be a bipolar type electrolyzer composed of a plurality of electrode elements.

Figure 3:
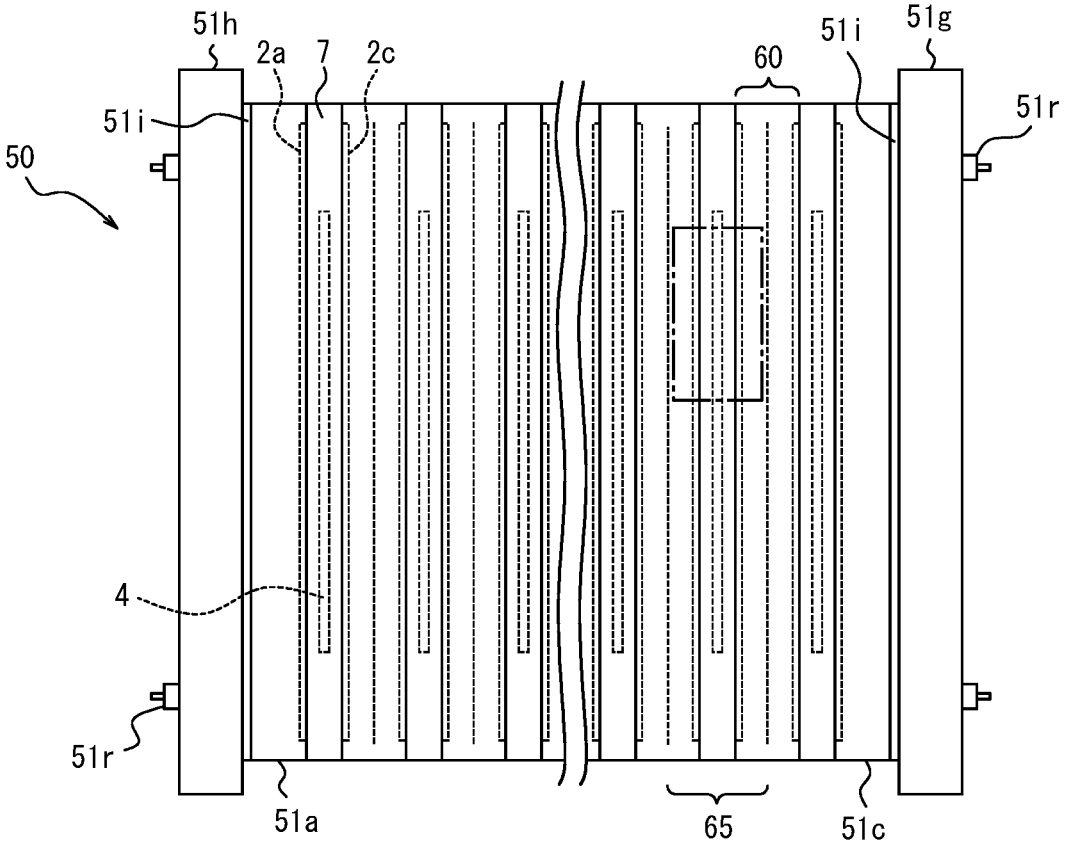
FIG. 3 is a schematic view of one example of the entire bipolar electrolyzer.

For example, the bipolar method is one method of connecting a large number of bipolar elements to a power supply and is a method in which a plurality of bipolar elements 60 each having an anode 2*a* as one surface thereof and a cathode 2*c* as one surface thereof are arranged in the same orientation and connected in series having membranes 4 interposed therebetween, and only both ends thereof are connected to the power supply (FIG. 3). One example of the electrolyzer is an electrolyzer having at least one structure in which an anode 2*a* of one element of two adjacent elements (e.g., two of adjacent elements of the anode terminal element 51*a*, the bipolar elements 60, and the cathode terminal element 51*c*) and a cathode 2*c* of the other element are arranged side by side having a diaphragm 4 interposed therebetween, for example. Preferably, a diaphragm 4 is provided between every two adjacent elements in the electrolyzer.

Bipolar electrolyzers have a feature of enabling a small power supply current and can be used to produce a large quantity of a compound, specific substance, or the like through electrolysis in a short time. Because power supply equipment having low current and high voltage is cheaper and more compact when power supply equipment having the same power is compared, the bipolar type is more preferable than the monopolar type from an industrial viewpoint.

An example of the electrolyzer 50 is illustrated in FIG. 3.

The electrolyzer 50 illustrated in FIG. 3 is a bipolar electrolyzer. The electrolyzer 50 includes, from one end thereof, a fast head 51*h*, an insulating plate 51*i*, and an anode terminal element 51*a* that are arranged in order, and further includes an anode-side gasket portion 7, a diaphragm 4, a cathode-side gasket portion 7, and a bipolar element 60 that are arranged in this order. In this case, the bipolar element 60 is arranged such that the corresponding cathode 2*c* faces toward the anode terminal element 51*a* side. Components from anode-side gasket portions 7 up to bipolar element 60 are repeatedly arranged as many times as required for the designed production quantity. After components from the anode-side gasket portion 7 up to the bipolar element 60 have been arranged repeatedly the required number of times, an anode-side gasket portion 7, a diaphragm 4, and a cathode-side gasket portion 7 are arranged again, and finally a cathode terminal element 51*c*, an insulating plate 51*i*, and a loose head 51*g* are arranged in this order.

The entire structure is then tightened together with a tightening device such as tie rods 51*r* (see FIG. 3) or an oil pressure cylinder to form a dipolar electrolyzer.

The bipolar elements 60 each include an anode 2*a*, a cathode 2*c*, a partition wall 1 separating the anode 2*a* and the cathode 2*c* from each other, and an outer frame 3 bordering the partition wall 1. The bipolar elements 60 are stacked one another having the membranes 4 interposed therebetween.

The order of arrangement of the bipolar electrolyzer can be arbitrarily selected from either the anode 2*a* side or the cathode 2*c* side and is not limited to the above order.

Figure 4:
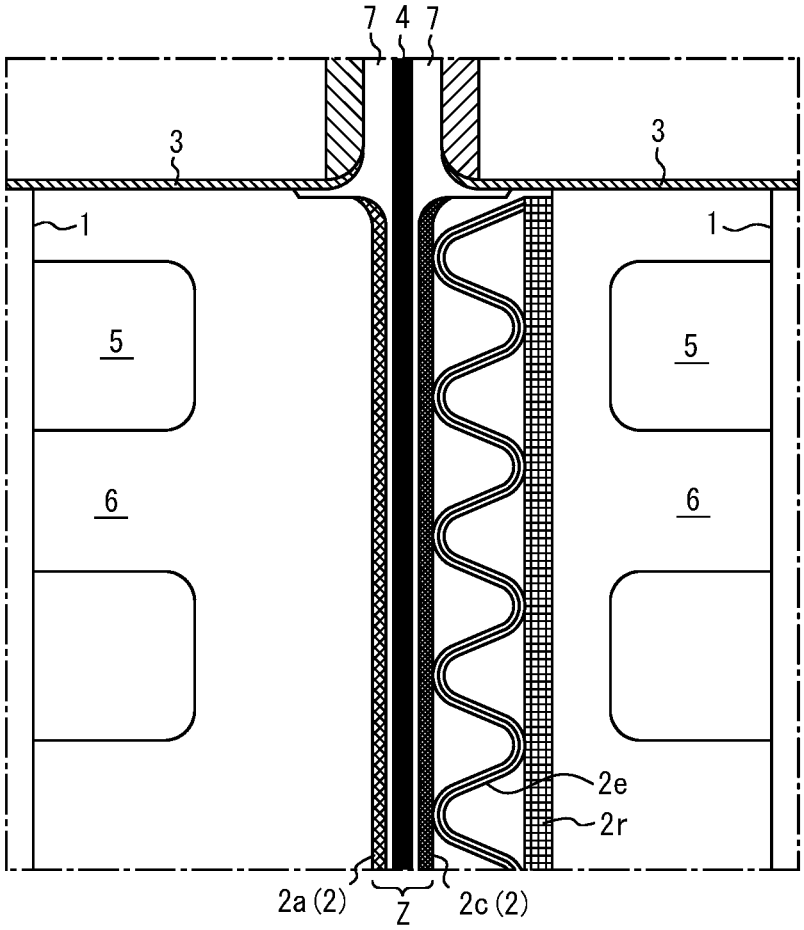
FIG. 4 is a schematic view illustrating a cross-section of a zero gap structure portion inside an electrolytic cell of the portion of the dotted square frame in FIG. 3.

In the electrolyzer 50, a partition wall 1, an outer frame 3, and a diaphragm 4 define an electrode compartment 5 through which an electrolytic solution passes (FIG. 4).

In particular, in the bipolar electrolyzer 50 according to the present embodiment, a portion between the partition walls 1 of two adjacent bipolar elements 60 and a portion between the partition walls 1 of each terminal element and of the adjacent bipolar element 60 are respectively referred to as an electrolytic cell 65 (FIG. 4). Each electrolytic cell 65 includes: a partition wall 1, an anode compartment 5*a*, and an anode 2*a* of one bipolar element; a diaphragm 4; and a cathode 2*c*, a cathode compartment 5*c*, and a partition wall 1 of the other bipolar element.

From the viewpoint of enhancing the rigidity of the anode and cathode, forming the structuring resistant to deformation even when being pressed, and controlling the direction of the electrolytic solution flowing in the electrode compartment, a rectifying plate (rib) 6 may be provided to each electrode (FIG. 4). Further, for the same reason, a structure of at least three layers may be adopted in which a current collector 2*r* is attached at the tip of a rectifying plate 6 (rib), a conductive elastic body 2*e* is attached at an upper surface side of the current collector 2*r* (i.e., at an opposite side to the partition wall 1 side), and an electrode 2 is stacked at an upper surface side thereof (i.e., at a part that is adjacent to the conductive elastic body 2*e* and becomes the diaphragm 4 side).

In the electrolyzer 50, a zero gap structure may be formed in which the diaphragm 4 is in contact with the anode 2*a* and the cathode 2*c* and is sandwiched therebetween (FIG. 4).

In the electrolyzer, the number of the electrolytic cells 65 is preferably 10 to 400, more preferably 50 to 250.

A header attached to the electrolyzer for causing the electrolytic solution and the gas to flow inside the electrolyzer is typically disposed as an internal header type or an external header type, and either type may be adopted.

The internal header type refers to a type in which an electrolyzer 50 and a header (a pipe for distributing or collecting an electrolytic solution) are integrated. For example, in an internal header type electrolyzer, an anode inlet header and a cathode inlet header are disposed at a lower part inside the partition wall 1 and/or outer frame 3 and extend in a direction perpendicular to the partition wall 1, whereas an anode outlet header and a cathode outlet header are disposed at an upper part inside the partition wall 1 and/or outer frame 3 and extend in a direction perpendicular to the partition wall 1.

The external header type refers to a type in which an electrolyzer 50 and a header (a pipe for distributing or collecting an electrolytic solution) are independent. For example, a bipolar electrolyzer of external header type is configured in such a manner that an anode inlet header and a cathode inlet header, and an anode outlet header and a cathode outlet header are independently provided so as to run in parallel to the electrolyzer in a direction perpendicular to the current-carrying surface of the electrolyzer. These headers and each bipolar element are connected by hoses.

—Electrode—

The types of the electrodes can be appropriately selected according to the type of the electrolytic reaction. For example, in the case of a water electrolysis apparatus, electrodes may be selected so that oxygen gas is generated at an anode and hydrogen gas is generated at a cathode. Further, in the case of a brine electrolysis apparatus, electrodes may be selected so that chlorine gas is generated at an anode and hydrogen gas is generated at a cathode.

The electrodes preferably have porous electrode substrates for the purpose of increasing the surface areas and promote efficient removal of gases generated through electrolysis from the electrode surfaces, etc. Examples of porous bodies that may be used include a plain weave mesh, a perforated metal, an expanded metal, and a metal foam. Among these, a mesh structure is preferred in view of achieving both a suitable specific surface area as a carrier and defoaming property.

A substrate may be used as an electrode, or alternatively, an electrode having a catalyst layer with high reaction activity on the surface of a substrate may be used. However, it is preferable to use an electrode having a catalyst layer with high reaction activity on the surface of a substrate.

The material of the substrate is preferably steel, stainless steel, nickel, or a nickel-based alloy, more preferably a substrate containing nickel in view of the resistance to the operating environment.

Examples of the method of forming the catalyst layer on the substrate include: a thermal spraying method such as plating or plasma spraying; a thermal decomposition method including applying a precursor layer solution onto a substrate followed by heating; a method including mixing a catalyst substance with a binder component and immobilizing it on a substrate; and a vacuum film-forming method such as a sputtering method.

In the case of alkaline water electrolysis, the catalyst layer of an anode preferably has a high oxygen-generating ability, and it is possible to use, for example, nickel, cobalt, iron, or a platinum group element. In order to achieve desired activity and durability, the catalyst layer is preferably formed using an elemental metal, a compound such as an oxide, a complex oxide or alloy composed of a plurality of metal elements, or a mixture thereof.

The catalyst layer of the cathode preferably has a high hydrogen generating ability, and it is possible to use, for example, nickel, cobalt, iron, or a platinum group element.

—Partition Wall—

The partition wall 1 is preferably made of a material having conductivity from the viewpoint of achieving uniform supply of electric power, and from the perspectives of alkali resistance and heat resistance, preferred materials include nickel, stainless steel, nickel alloy, and nickel alloy or steel plated with nickel.

—Diaphragm—

An ion permeable diaphragm 4 is preferably used as the diaphragm 4 to separate generated gases (for example, hydrogen gas and oxygen gas in the case of alkaline water electrolysis) while permitting passage of ions. An ion exchange membrane having ion exchange ability, or a porous membrane capable of permeating the electrolytic solution, or the like can be used as this ion permeable diaphragm 4. The ion permeable diaphragm 4 preferably has low gas permeability, high ionic conductivity, and high strength.

—Gasket—

In the electrolyzer 50, as illustrated in FIGS. 3 and 4, it is preferable that a gasket 7 is sandwiched between the outer frames 3 bordering the partition walls 1 together with the diaphragm 4. The gasket 7 is used for providing a seal against the electrolyte and generated gas between the bipolar element 60 and the diaphragm 4 and between the bipolar elements 60, and to prevent leakage of the electrolytic solution and generated gas to the outside of the electrolyzer and mixing of gases between the bipolar compartments.

Examples of the material of the gasket include rubber such as EPDM rubber.

Here, in particular, in an electrolysis system 70 including an oil pressure tightening device 90 provided with an accumulator 96 (see FIG. 1), the oil pressure of the tightening device 90 may change as follows due to change in the temperature of the electrolytic cell and the sealability (see FIG. 5) of the gasket 7 may be lost.

(1) When the temperature of the electrolytic cell increases due to electrolysis, the oil temperature of the tightening device 90 also increases due to heat conduction and the temperature of the gas enclosed in the accumulator 96 also increases.

(2) When the gas enclosed in the accumulator 96 expands due to the temperature increase, the oil pressure increases and the tightening surface pressure on the electrolyzer 50 increases. As a result, the gasket 7 is compressed in the tightening direction, and the gasket 7 escapes (protrudes) out of the tightening surface.

(3) After the electrolysis is completed and the temperature of the electrolytic cell decreases, the oil temperature of the tightening device 90 also decreases and the temperature of the gas enclosed in the accumulator 96 also decreases.

(4) When the gas enclosed in the accumulator 96 shrinks due to the temperature decrease, the oil pressure decreases and the tightening surface pressure on the electrolyzer 50 also decreases. However, once the gasket 7 protrudes outward, the gasket 7 cannot return to its original state before the electrolysis is carried out due to the large resistance and the gasket 7 remains protruding outward.

(5) The gasket 7 protrudes further through repetition of (1) to (4). When the protrusion of the gasket 7 worsens, the sealability may be lost and the electrolytic solution or the generated gas may leak. In addition, as the gasket 7 protrudes further, the pressure receiving area of the gasket 7 subjected to the tightening load would be reduced and the tightening surface pressure on the gasket 7 would become excessive. The excessive tightening surface pressure would cause cracking of the gasket 7, which would cause loss of sealability.

In order to prevent changes in the oil pressure and a resultant loss of sealability of the gasket 7 as set forth above, the electrolyzer 50 may include at least one electrolytic cell and two press plates arranged at both ends of the electrolyzer 50 so as to sandwich the at least one electrolytic cell, and one of the two press plates and the oil pressure tightening device 90 may be connected to each other, and a heat insulating member may be provided between at least the press plate connected to the oil pressure tightening device 90 and the at least one electrolytic cell, among the at least one electrolytic cell and the two press plates.

By providing the heat insulating member between at least the electrolytic cell and the press plate connected to the oil pressure tightening device 90, it is possible to reduce heat conduction from the electrolyzer to the oil pressure tightening device 90 when the temperature of the electrolytic cell becomes high during electrolysis. As a result, it is possible to mitigate a change in the oil pressure as described in (1) to (4) above, which is particularly effective in an electrolysis system using an oil pressure tightening device 90 without a mechanism to automatically control the oil pressure. The configuration is also effective in an electrolyzer system including an oil pressure tightening device 90 having a mechanism to automatically control the oil pressure in case where the oil pressure is maintained only by the accumulator 96, such as in case of a power failure or the like. In addition, by mitigating a change in the oil pressure, it is possible to prevent the gasket 7 from being compressed and protruding outward, and thus it is possible to reduce the loss of sealability of the gasket 7.

—Press Plate—

The press plates are disposed at both ends of the electrolyzer 50 so as to sandwich the electrolytic cell, and applies a tightening surface pressure to the electrolyzer 50 by means of a tightening load from the oil pressure tightening device 90.

Figure 5:
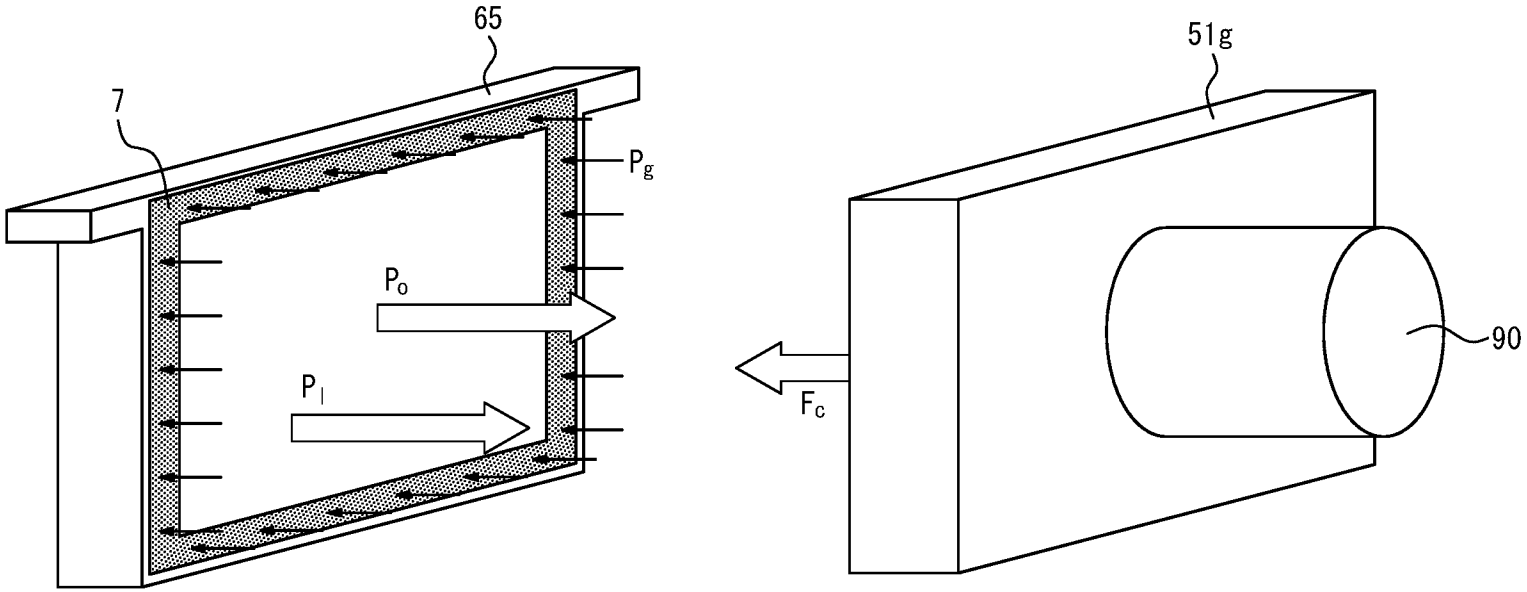
FIG. 5 is a schematic view illustrating one example of a tightening device of the electrolysis system of the present embodiment.

The press plates correspond to the fast head 51*h* and the loose head 51*g* in the electrolyzer 50 in FIG. 3 (however, the tightening device of the electrolyzer 50 is changed from a tie rod type to a oil pressure type), for example, and the loose head 51*g* in FIG. 5 corresponds to the press plate connected to the oil pressure tightening device 90, for example.

The material of the press plates is not particularly limited, and conventionally known materials can be used. Specific examples include stainless steel, carbon steel for mechanical structures, and nickel.

—Heat Insulating Member—

A heat insulating member is disposed between the electrolytic cell (in cases where a plurality of electrolytic cells are connected to each other, the connected electrolytic cell stack) and a press plate to reduce heat conduction from the electrolytic cell to the press plate during electrolysis. Accordingly, when the temperature of the electrolytic cell becomes high during electrolysis, heat conduction from the electrolytic cell via the press plate to the oil pressure tightening device 90 can be mitigated, and an increase in the oil temperature can be suppressed.

It is suffice that the heat insulating member may be disposed at least between the press plate connected to the oil pressure tightening device 90 and the electrolytic cell (electrolytic cell stack in cases where a plurality of electrolytic cells are provided), but is more preferably disposed between each press plate and the electrolytic cell (electrolytic cell stack in cases where a plurality of electrolytic cells are provided).

The material of the heat insulating member is preferably a material having a low thermal conductivity, and examples include polytetrafluoroethylene (PTFE), polyvinyl chloride, polyether ether ketone (PEEK), and polyoxymethylene (POM). Among these, PTFE and polyvinyl chloride which have low thermal conductivities and are expected to be electrically insulative are preferred.

The heat insulating member preferably has a thermal conductivity at 100° C. of 10 W/m·K or less, more preferably 1 W/m·K or less, even more preferably 0.5 W/m·K or less, still more preferably 0.3 W/m·K or less, and particularly preferably 0.1 W/m·K or less.

The thermal conductivity A of the heat insulating member at the electrolysis temperature is preferably lower than the thermal conductivity B of the press plates at the electrolysis temperature. Because the thermal conductivity A is lower than the thermal conductivity B, heat conduction to the oil pressure tightening device 90 connected to the press plate is reduced, and an increase in the oil temperature can be mitigated. Thus, an increase in the temperature and expansion of the gas enclosed in the accumulator 96 can be mitigated, and an increase in the oil pressure can be prevented.

The thermal conductivity is a value measured by a steady-state method such as a protective heat plate method.

The heat insulating member is electrically insulative. Hence, the volume resistivity of the heat insulating member at the electrolysis temperature is preferably 1 kΩ·cm or more, more preferably 1 MΩ·cm or more, and even more preferably 1 GΩ·cm or more.

The volume resistivity is a value measured by a constant voltage application/leakage current measurement method.

The heat insulating member which is electrically insulative may also serve as an insulating plate (for example, the insulating plate 51*i* in the electrolyzer 50 of FIG. 3; however, the tightening device of the electrolyzer 50 may be changed from the tie rod type to the oil pressure type). Or, in the case where both a heat insulating member and an insulating plate are provided, the heat insulating member, the insulating plate, and the press plate may be arranged in this order, or the insulating plate, the heat insulating member, and the press plate may be arranged in this order.

(Pressure Gauge)

A pressure gauge 78 may be installed inside the electrolyzer or outside the electrolyzer. However, because a voltage is applied to the main body of the electrolyzer, installation of a power transmission type pressure gauge may be inappropriate. Thus, a pressure gauge is generally installed outside the electrolyzer. The gas pressure inside the electrolyzer and the gas pressure downstream to the electrolyzer can be considered to be substantially equal, unless a large pressure loss occurs in the outlet piping in the system.

(Electrolytic Solution Circulation Pump)

The electrolytic solution circulation pump 71 is not particularly limited and may be configured as appropriate.

The electrolytic solution circulating pump 71 makes the electrolytic solution flowing through the electrolyzer 50 and the piping 81 to be circulated.

(Gas-Liquid Separation Tank)

The gas-liquid separation tanks 72 are preferably tanks for separating the electrolytic solution and gases generated in the electrolyzer, and are preferably an anode-side gas-liquid separation tank 72*o* for separating gas generated at the anode of the electrolyzer and the electrolytic solution and a cathode-side gas-liquid separation tank 72*h* for separating gas and generated at the cathode of the electrolyzer and the electrolytic solution.

For example, in the case of alkaline water electrolysis, oxygen is generated at the anode and hydrogen at the cathode. In this case, the anode-side gas-liquid separation tank 72*o* is an oxygen separation tank and the cathode-side gas-liquid separation tank 72*h* is a hydrogen separation tank.

(Piping)

The piping 81 is not particularly limited and may be configured as appropriate.

The piping 81 is piping which permits the electrolytic solution to flow out of the electrolyzer 50. For example, as illustrated in FIG. 1, it can connect between the electrolyzer 50 and the gas-liquid separation tank 72, between the gas-liquid separation tank 72 and the electrolytic solution circulation pump 71, and between the electrolytic solution circulation pump 71 and the electrolyzer 50.

Note that the gases separated by the gas-liquid separation tanks 72 are preferably lead to the pressure gauges 78, the pressure control valves 80, the concentration meters 75, 76 through piping used for gases.

(Feed Power Supply)

The feed power supply is preferably a dc power supply.

The feed power supply may be a power supply relying on electric power generated though power generation by an energy source of which output fluctuates such as a renewable energy (variable power supply) or a power supply of which output may be substantially constant (constant power supply), or may be a combination of these. Among these, from the viewpoint that generation of green house gases are reduced and the effects of the present disclosure become more remarkable, the feed power supply is more preferably a variable power supply or constant power supply relying on at least one renewable energy output selected from the group consisting of wind, solar, hydraulic, tidal, wave, ocean current, and geothermal power outputs, and even more preferably a variable power supply relying on a solar power output or a power supply relying on a wind power output.

Because tightening of the electrolyzer may vary when supply of electric power from a feed power supply is stopped such as upon a power outage or when a power supply is stopped, the present disclosure is effective even in cases in which a constant power supply is used as the feed power supply. Examples of the constant power supply include a source of electric power supplied through a grid and a storage battery power supply. The source of electric power supplied through a grid may be a power supply relying on a stable source of electric power such as thermal and nuclear power sources, or may be a combination of a variable power supply such as one relying on a renewable energy output or the like and a power supply relying on stable power supply.

Electric power supplied from the power supplies may be converted to a dc power by a rectifier before it is supplied to the electrolyzer. One rectifier may be provided immediately before the electrolyzer, or rectifiers may be provided between the respective power supplies and the electrolyzer.

Examples of the electrolysis include water electrolysis, brine electrolysis, inorganic electrolysis, and organic electrolysis. Among these, an alkaline water electrolysis apparatus, a solid polymer water electrolysis apparatus, or an ion-exchange membrane brine electrolysis apparatus is preferred from the viewpoint of responsiveness to a variable power supply.

[Method of Use of Electrolysis System]

The electrolysis system of the present embodiment described above is used in a method of use of the present embodiment.

For example, the electrolysis system is used, wherein electric power is supplied to the electrolyzer to cause an electrolytic reaction to take place in the electrolyzer, and a tightening load on the electrolyzer is controlled in accordance with the pressure of a gas generated from the electrode.

The electrolysis system can be used, for example, for alkaline water electrolysis, solid polymer water electrolysis, and brine electrolysis.

In the case of alkaline water electrolysis, an alkaline water solution in which an alkali salt is dissolved may be used as the electrolysis solution, and a water solution of NaOH, a water solution of KOH solution, or the like may be used for production of hydrogen gas generated at the cathode and/or production of oxygen gas generated at the anode.

In the case of solid polymer water electrolysis, the electrolysis system may be used for production of hydrogen gas generated at the cathode and/or production of oxygen gas generated at the anode by means of electrolysis of water at the anode and proton transfer through the ion exchange membrane.

In the case of brine electrolysis, brine and NaOH may be used as the electrolysis solution for production of hydrogen gas generated at the cathode and/or for production of chlorine gas generated at the anode.

EXAMPLES

Figure 7:
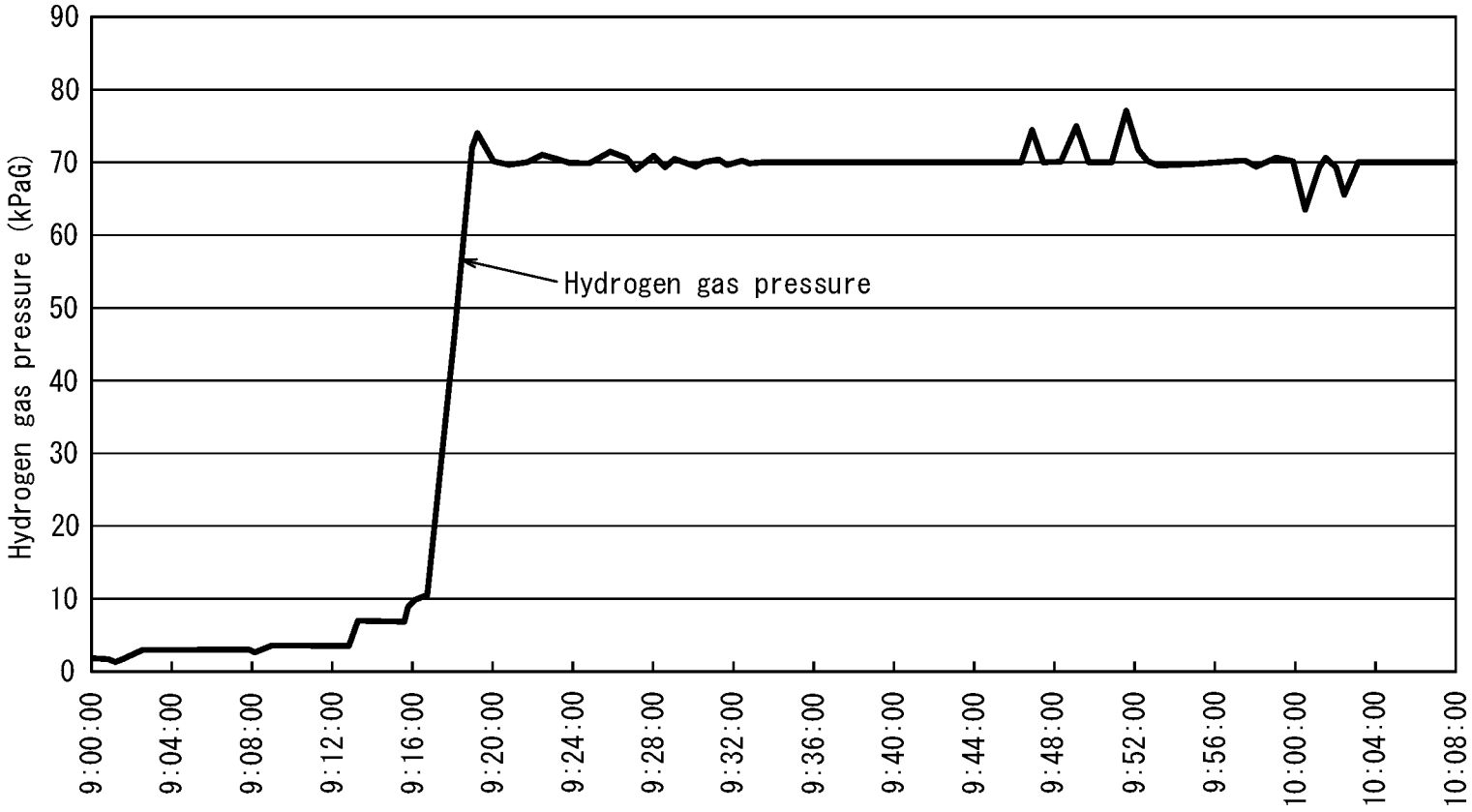
FIG. 7 is a graph of change over time of the pressure of hydrogen gas handled in Examples.

FIG. 7 is an example of a graph of change over time of the pressure of hydrogen gas accompanied by starting and a variable operation of a water electrolysis apparatus. The pressure increases in several minutes from substantially atmospheric pressure (about 2 kPaG) to about 70 kPaG, which is the operating pressure. Thereafter, the pressure rises and falls within a range of ±10 kPa in accordance with change in the output.

Figure 8:
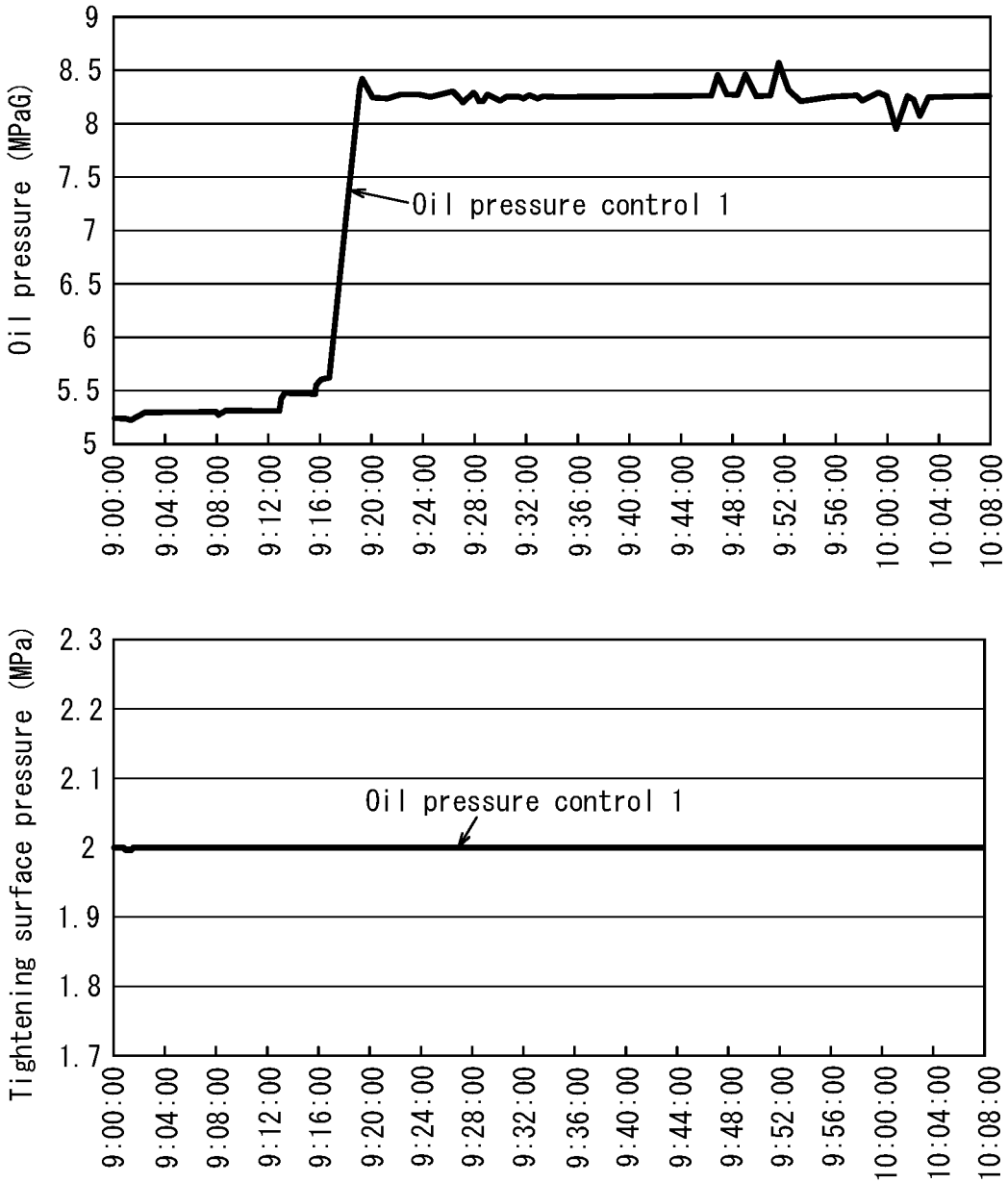
FIG. 8 is an example of changes in the oil pressure and the tightening surface pressure when the oil pressure control 1 is used.
Figure 9:
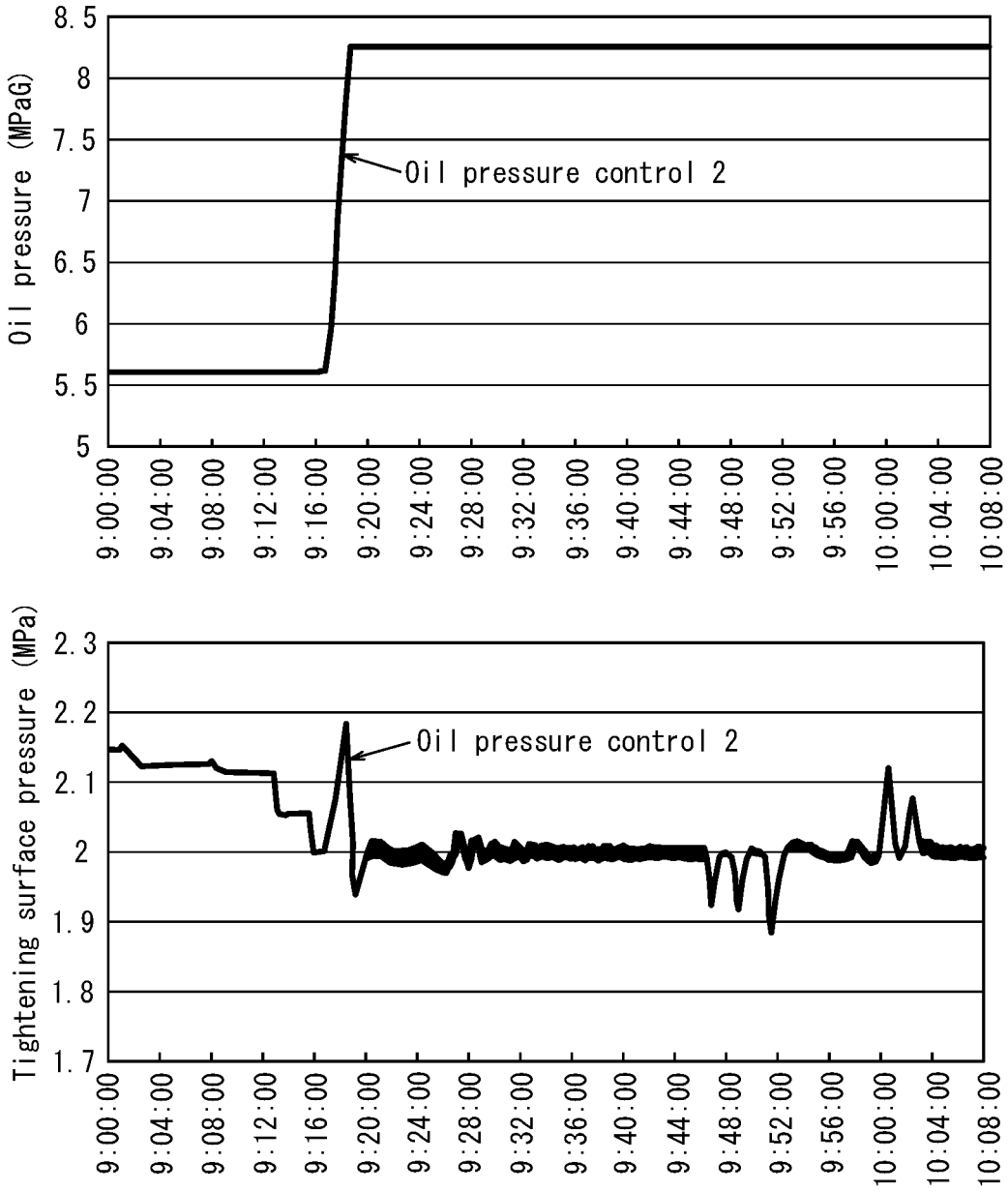
FIG. 9 is an example of changes in the oil pressure and the tightening surface pressure when the oil pressure control 2 is used.

Simulation results when the two types of oil pressure control methods illustrated in FIG. 6 are applied to the change in the gas pressure are depicted in FIGS. 8 and 9. In an embodiment (FIG. 8) in which an oil pressure control 1 for linearly increasing the oil pressure of the tightening device in accordance with the pressure of hydrogen gas is applied, the oil pressure slightly rises and falls in accordance with the change in the gas pressure, but the tightening surface pressure hardly varies and remains at 2 MPa.

On the other hand, in an embodiment (FIG. 9) in which an oil pressure control 2 provided with dead zones is applied, it can be seen that the oil pressure is responsive to a large change in the gas pressure, whereas the oil pressure does not respond to small changes in the gas pressure. As a consequence, changes in the pressure are reflected in the tightening surface pressure. However, because the changes in the pressure remain within the range of 2 MPa±0.2 MPa, it can be considered that there is no adverse effect, such as damages to airtightness or members.

Figure 10A:
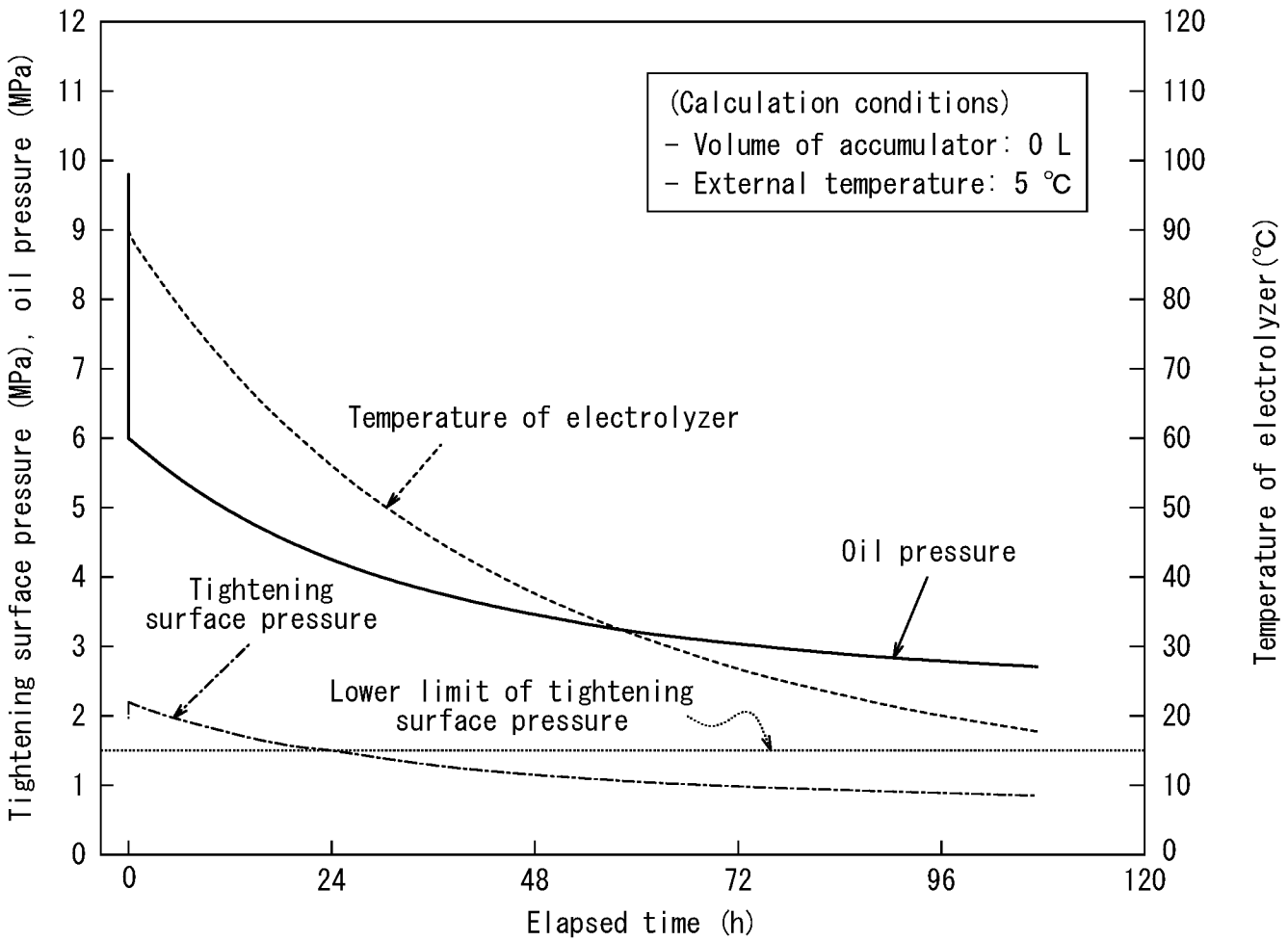
FIG. 10A illustrates results of simulated changes in the oil pressure, the tightening surface pressure, and the temperature of an electrolyzer in the event of a power failure during an operation of a water electrolysis system having an oil pressure tightening device without an accumulator.
Figure 10B:
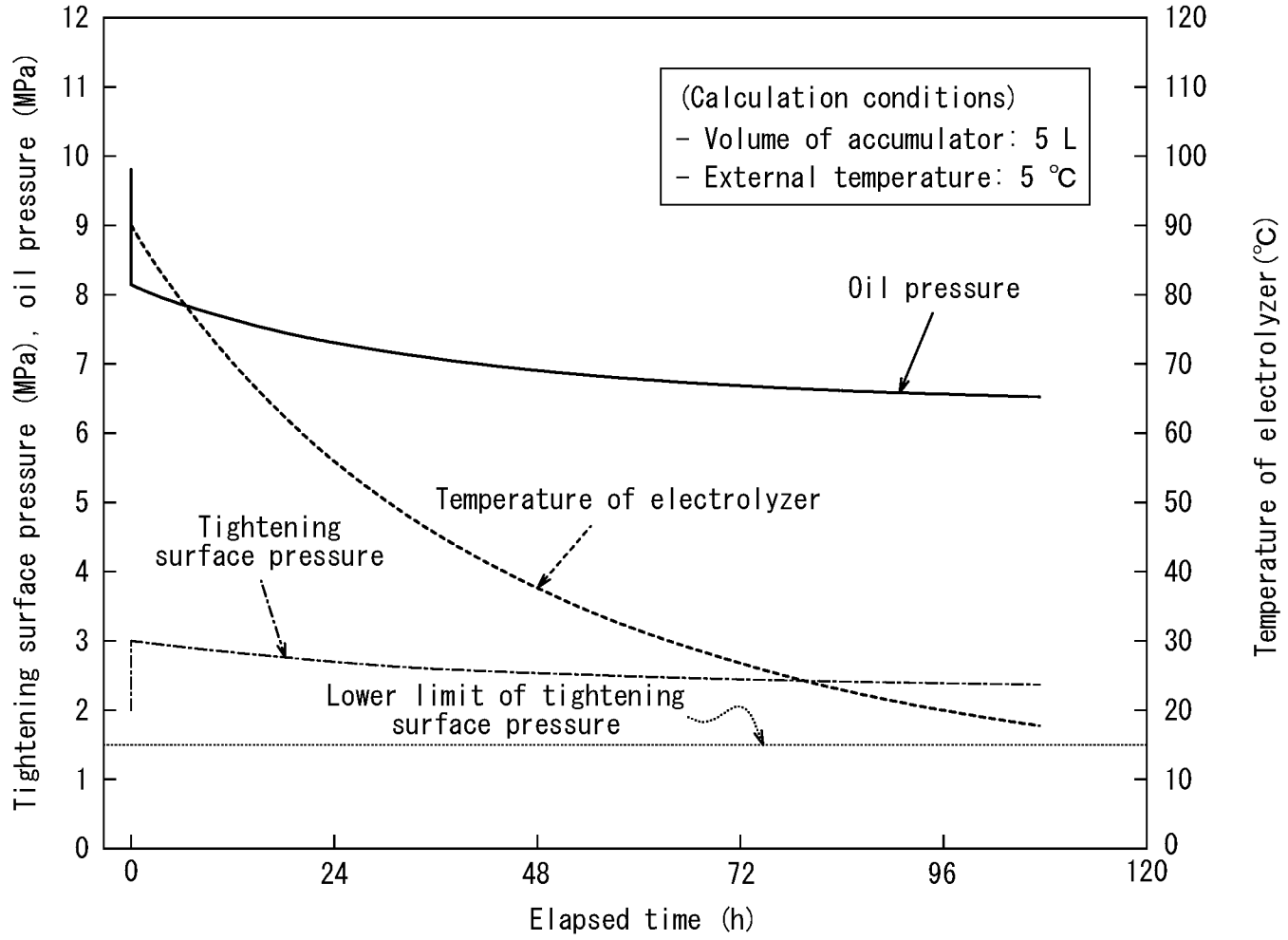
FIG. 10B illustrates results of simulated changes in the oil pressure, the tightening surface pressure, and the temperature of an electrolyzer in the event of a power failure during an operation of a water electrolysis system having an oil pressure tightening device provided with an accumulator.
Figure 10C:
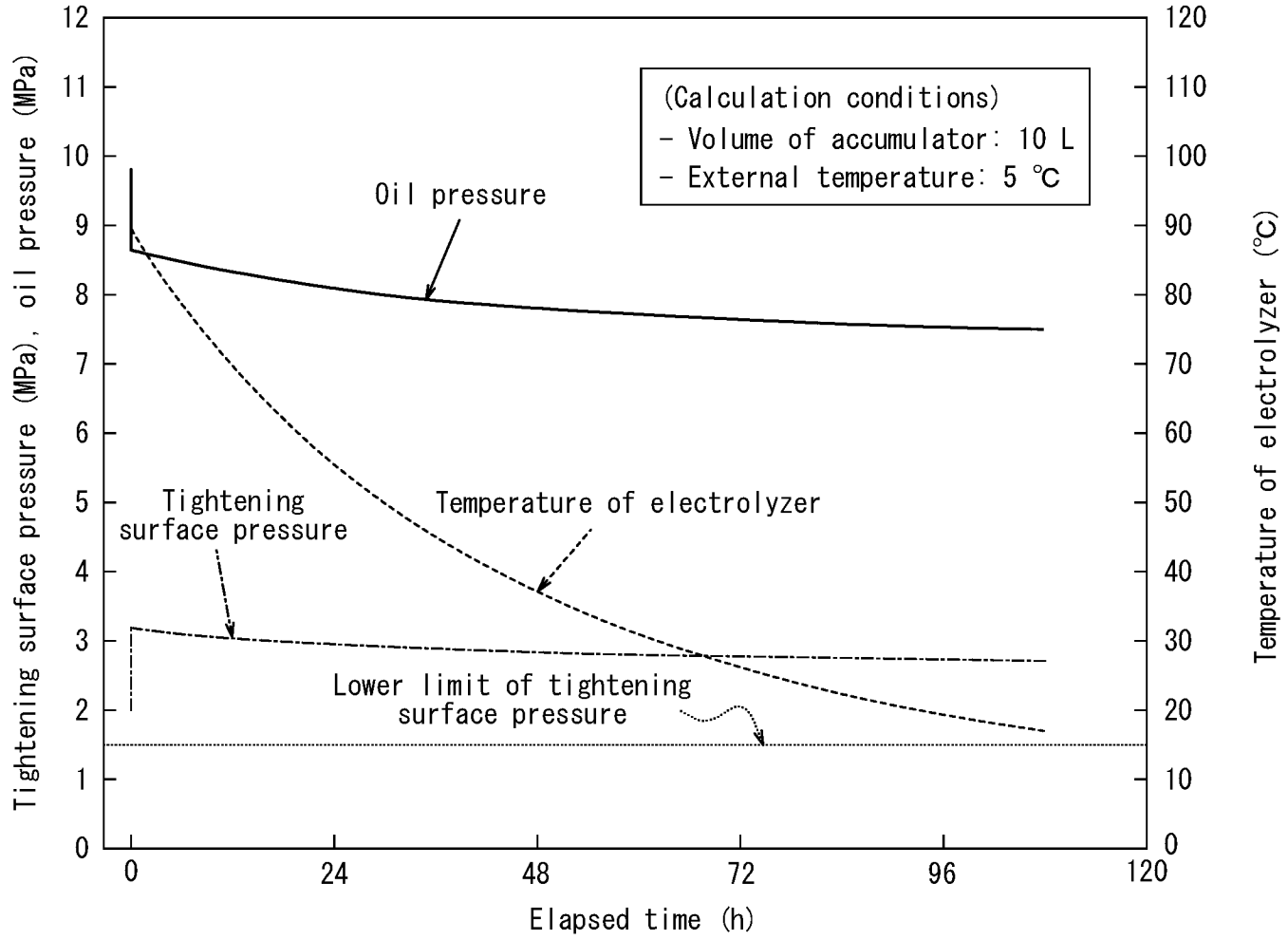
FIG. 10C illustrates results of simulated changes in the oil pressure, the tightening surface pressure, and the temperature of an electrolyzer in the event of a power failure during an operation of a water electrolysis system having an oil pressure tightening device provided with an accumulator.

Simulation results simulating cases where a power failure occurs during an operation at an external air temperature of 5° C. in a water electrolysis system 70 (see FIG. 1) provided with an oil pressure clamping device 90 are depicted in FIGS. 10A to 10C. It is assumed that the electrolyzer is not provided with a heat insulating means.

When a power failure occurs, the oil pressure pump 95 is stopped, and the shut-off valve 92 is also automatically closed so as to maintain the oil pressure in the oil pressure cylinder 91. Subsequently, hydrogen gas and oxygen gas in the electrolyzer 50 are automatically released into the atmosphere for safety reason. As a result, the oil pressure is received only by the gasket 7, and the tightening surface pressure on the gasket 7 increases.

After the time elapses further, the temperature of the electrolyzer 50 gradually decreases due to lack of heat source, and the length of the electrolyzer 50 decreases due to heat shrinkage. As a result, the oil pressure cylinder 91 gradually extends (for example, in the case of FIG. 1, the piston of the oil pressure cylinder 91 gradually moves to the right). The oil pressure, however, rapidly decreases due to lack of supply source of the oil pressure. Hence, in the simulated result in the case where the oil pressure tightening unit 90 without the accumulator 96 is used (FIG. 10A), the tightening surface pressure on the gasket 7 reaches the lower limit of 1.5 MPa after approximately 30 hours. When the power failure is further prolonged, the surface pressure reaches to the point at which an event such as leakage of an electrolyte solution may occur.

In contrast, in the case where the oil pressure tightening device 90 provided with the accumulator 96 is used, the gas (gas bag) enclosed in the accumulator 96 expands to compensate for the extension of the oil pressure cylinder 91, so that the oil pressure can be maintained at a high level. Hence, in the simulated results simulating cases where the accumulator 96 was provided (FIG. 10B and FIG. 10C), it was confirmed that sufficient tightening surface pressures were maintained even after 100 hours. FIG. 10B illustrates the simulation results when the accumulator 96 having a capacity of 5 L is used, and FIG. 10C illustrates the simulation results when the accumulator 96 having a capacity of 10 L is used.

REFERENCE SIGNS LIST

1 Partition wall
2 Electrode
2*a* Anode
2*c* Cathode
2*e* Conductive elastic body
2*r* Current collector
3 Outer frame
4 Diaphragm
5 Electrode compartment
6 Rib
7 Gasket
50 Electrolyzer
77*h* Fast head
51*g* Loose head
51*i* Insulating plate
51*a* Anode terminal element
51*c* Cathode terminal element
51*r* Tie rod
60 Bipolar element
65 Electrolytic cell
70 Electrolysis system
71 Electrolytic solution circulating pump
72 Gas-liquid separation tank
72*h* Cathode-side gas-liquid separation tank
72*o* Anode-side gas-liquid separation tank
74 Feed power supply
75 Concentration meter
76 Concentration meter
77 Flow meter
78 Pressure gauge
79 Heat exchanger
80 Pressure control valve
81 Piping
90 Tightening device
91 Cylinder
92 Shut-off valve
93 Relief valve
94 Tank
95 Pump
96 Accumulator
Z Zero gap structure

The invention claimed is:

1. An electrolysis system comprising:
an electrolyzer which comprises an electrode to generate a gas from the electrode, and
a tightening device which controls a tightening load on the electrolyzer in accordance with a pressure of the gas,
wherein the tightening device comprises an accumulator, the accumulator comprises a bladder,
the tightening device is an oil pressure tightening device,
the electrolyzer comprises at least one electrolytic cell, and two press plates disposed at both ends of the electrolyzer so as to sandwich the at least one electrolytic cell,
one of the two press plates and the oil pressure tightening device are connected to each other,
the electrolysis system further comprises a heat insulating member between at least the press plate connected to the oil pressure tightening device and the at least one electrolytic cell, among the at least one electrolytic cell and the two press plates, and
the tightening load is controlled to maintain a tightening surface pressure of 0.5 MPa to 4.0 MPa.

2. The electrolysis system according to claim 1, wherein the tightening load changes in proportion to the pressure of the gas.

3. The electrolysis system according to claim 1, wherein the tightening load is maintained to a constant value when the pressure of the gas is within a certain range.

4. The electrolysis system according to claim 1, wherein the tightening load is controlled with reference to an electrolysis current value.

5. The electrolysis system according to claim 1, wherein a capacity of the accumulator is 0.1 L or more and 100 L or less.

6. The electrolysis system according to claim 1, wherein the electrolysis system is for alkaline water electrolysis.

7. The electrolysis system according to claim 2, wherein a capacity of the accumulator is 0.1 L or more and 100 L or less.

8. The electrolysis system according to claim 2, wherein the electrolysis system is for alkaline water electrolysis.

9. The electrolysis system according to claim 1, wherein the accumulator further comprises a container, and the bladder is disposed within the container.

* * * * *